US006438758B1

(12) United States Patent
Burkard et al.

(10) Patent No.: US 6,438,758 B1
(45) Date of Patent: Aug. 27, 2002

(54) FEEDING TUBE ACCESSIBLE WEARING APPAREL

(76) Inventors: Kathleen A. Burkard, 946 Sweet Home Rd., Amherst, NY (US) 14226; Renee M. Dickerson, 155 Farmingdale Rd., Cheektowaga, NY (US) 14225

( * ) Notice: Subject to any disclaimer, the term of this patent is extended or adjusted under 35 U.S.C. 154(b) by 63 days.

(21) Appl. No.: 09/895,239

(22) Filed: Jun. 29, 2001

(51) Int. Cl.[7] ..... A41B 1/00
(52) U.S. Cl. ..... 2/115; 2/114
(58) Field of Search ..... 2/115, 113, 114, 2/69, 1, DIG. 1, 104; 604/174, 179, 180, 189; 40/586

(56) References Cited

U.S. PATENT DOCUMENTS 1,098,155 A * 5/1914 Knapp ..... 2/104
1,290,142 A * 1/1919 Elowsky ..... 2/104
2,788,785 A * 4/1957 Present ..... 2/400
4,533,355 A * 8/1985 Fair ..... 604/174
4,578,062 A * 3/1986 Schneider ..... 604/174
4,663,782 A * 5/1987 Knox et al. ..... 2/104
4,813,081 A 3/1989 Cliff et al.
5,005,218 A 4/1991 Ganz
5,048,512 A * 9/1991 Turner et al. ..... 128/876
5,103,501 A * 4/1992 Meisels ..... 2/113
5,142,702 A 9/1992 Piloian
D365,914 S 1/1996 Vaughan et al.
5,755,698 A * 5/1998 Kagan et al. ..... 604/179
5,799,330 A * 9/1998 O'Donoghue-Kitt ..... 2/114
5,806,096 A 9/1998 Pennington
6,032,289 A * 3/2000 Villapiano ..... 2/102
6,125,472 A 10/2000 Nakagawa
6,148,444 A * 11/2000 Holmes et al. ..... 2/69

* cited by examiner

*Primary Examiner*—Gloria M. Hale

(57) ABSTRACT

A feeding tube accessible wearing apparel for giving a user a sense dignity and privacy during a medical procedure. The feeding tube accessible wearing apparel includes an upper body garment having a neck-receiving opening and arm-receiving openings and also having a front side with a hole being disposed through the front side; and also includes a flap member being attached to the front side of said upper body garment and being coverable over the hole.

4 Claims, 2 Drawing Sheets

FEEDING TUBE ACCESSIBLE WEARING APPAREL

BACKGROUND OF THE INVENTION

1. Field of the Invention

The present invention relates to tube accessible wearing apparels and more particularly pertains to a new feeding tube accessible wearing apparel for giving a user a sense dignity and privacy during a medical procedure.

2. Description of the Prior Art

The use of tube accessible wearing apparels is known in the prior art. More specifically, tube accessible wearing apparels heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,142,702; U.S. Pat. No. 6,125,472; U.S. Pat. No. 4,813,081; U.S. Pat. No. 5,005,218; U.S. Pat. No. 5,806,096; and U.S. Pat. No. Des. 365,914.

While these devices fulfill their respective, particular objectives and requirements, the aforementioned patents do not disclose a new feeding tube accessible wearing apparel. The inventive device includes an upper body garment having a neck-receiving opening and arm-receiving openings and also having a front side with a hole being disposed through the front side; and also includes a flap member being attached to the front side of said upper body garment and being coverable over the hole.

In these respects, the feeding tube accessible wearing apparel according to the present invention substantially departs from the conventional concepts and designs of the prior art, and in so doing provides an apparatus primarily developed for the purpose of giving a user a sense dignity and privacy during a medical procedure.

SUMMARY OF THE INVENTION

In view of the foregoing disadvantages inherent in the known types of tube accessible wearing apparels now present in the prior art, the present invention provides a new feeding tube accessible wearing apparel construction wherein the same can be utilized for giving a user a sense dignity and privacy during a medical procedure.

The general purpose of the present invention, which will be described subsequently in greater detail, is to provide a new feeding tube accessible wearing apparel which has many of the advantages of the tube accessible wearing apparels mentioned heretofore and many novel features that result in a new feeding tube accessible wearing apparel which is not anticipated, rendered obvious, suggested, or even implied by any of the prior art tube accessible wearing apparels, either alone or in any combination thereof.

To attain this, the present invention generally comprises an upper body garment having a neck-receiving opening and arm-receiving openings and also having a front side with a hole being disposed through the front side; and also includes a flap member being attached to the front side of said upper body garment and being coverable over the hole.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new feeding tube accessible wearing apparel which has many of the advantages of the tube accessible wearing apparels mentioned heretofore and many novel features that result in a new feeding tube accessible wearing apparel which is not anticipated, rendered obvious, suggested, or even implied by any of the prior art tube accessible wearing apparels, either alone or in any combination thereof.

It is another object of the present invention to provide a new feeding tube accessible wearing apparel which may be easily and efficiently manufactured and marketed.

It is a further object of the present invention to provide a new feeding tube accessible wearing apparel which is of a durable and reliable construction.

An even further object of the present invention is to provide a new feeding tube accessible wearing apparel which is susceptible of a low cost of manufacture with regard to both materials and labor, and which accordingly is then susceptible of low prices of sale to the consuming public, thereby making such feeding tube accessible wearing apparel economically available to the buying public.

Still yet another object of the present invention is to provide a new feeding tube accessible wearing apparel which provides in the apparatuses and methods of the prior art some of the advantages thereof, while simultaneously overcoming some of the disadvantages normally associated therewith.

Still another object of the present invention is to provide a new feeding tube accessible wearing apparel for giving a user a sense dignity and privacy during a medical procedure.

Yet another object of the present invention is to provide a new feeding tube accessible wearing apparel which includes an upper body garment having a neck-receiving opening and arm-receiving openings and also having a front side with a hole being disposed through the front side; and also includes a flap member being attached to the front side of said upper body garment and being coverable over the hole.

Still yet another object of the present invention is to provide a new feeding tube accessible wearing apparel that is easy and convenient to use.

Even still another object of the present invention is to provide a new feeding tube accessible wearing apparel that eliminates the user have to bare oneself for a medical procedure such as gastronomical feeding.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
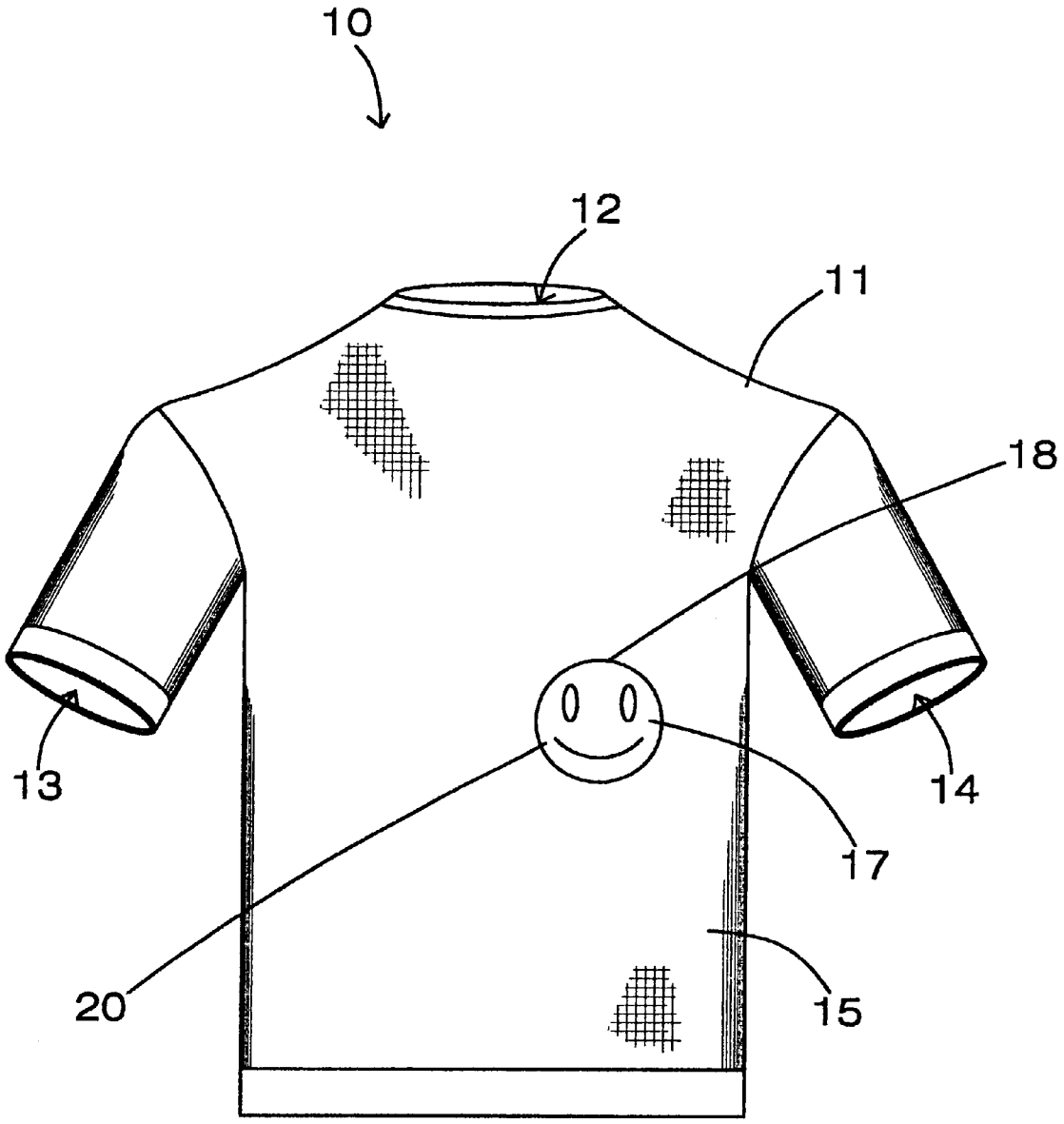
FIG. 1 is a front elevational view of a new feeding tube accessible wearing apparel according to the present invention.
Figure 2:
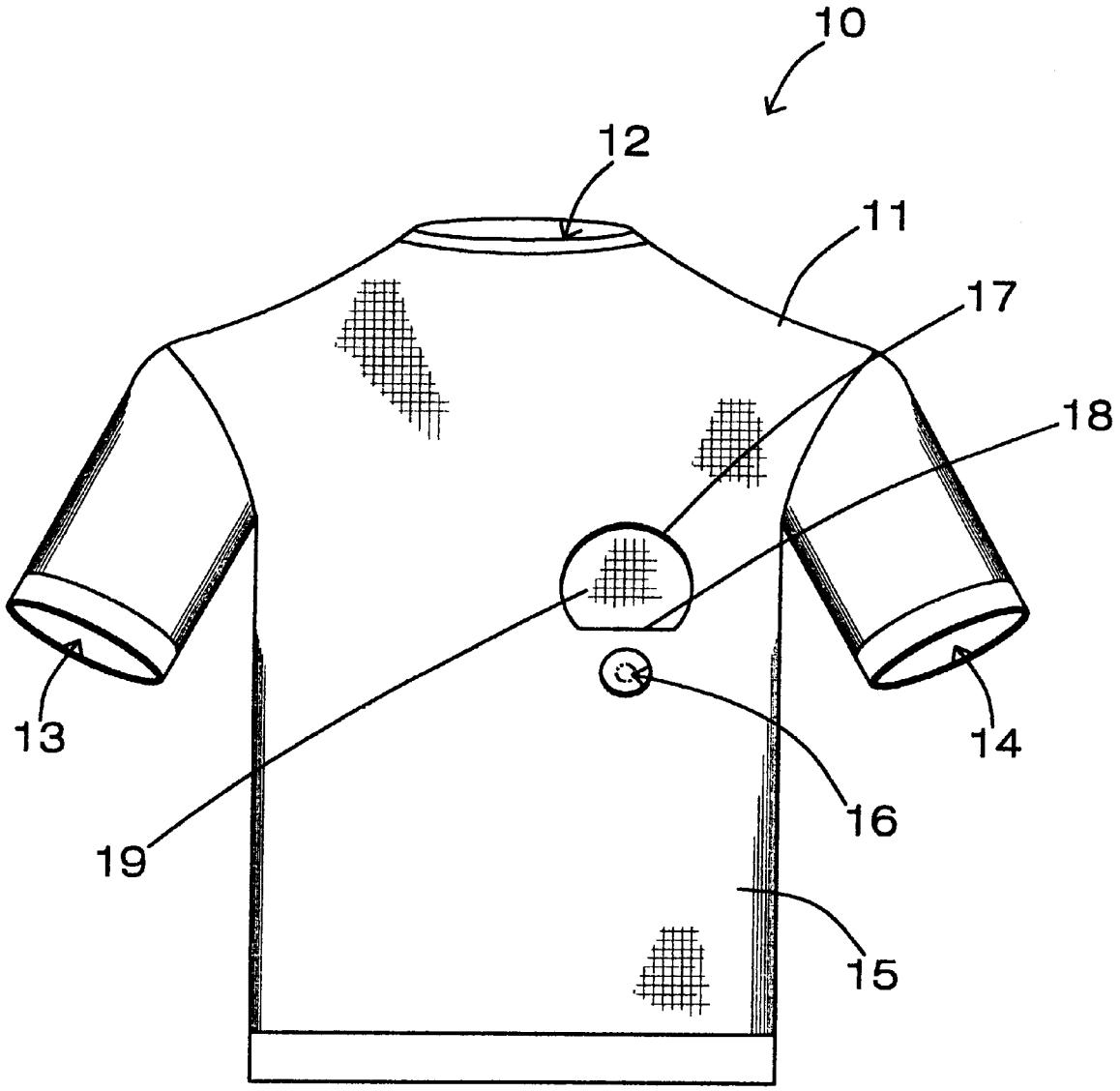
FIG. 2 is another front elevational view of the present invention.

With reference now to the drawings, and in particular to FIGS. 1 through 2 thereof, a new feeding tube accessible wearing apparel embodying the principles and concepts of the present invention and generally designated by the reference numeral 10 will be described.

As best illustrated in FIGS. 1 through 2, the feeding tube accessible wearing apparel 10 generally comprises an upper body garment 11 having a neck-receiving opening 12 and arm-receiving openings 13,14 and also having a front side 15 with a hole 16 being disposed through the front side 15. The hole 16 is adapted to receive a gastronomical feeding tube therethrough. A flap member 17 is conventionally attached to the front side 15 of the upper body garment 11 and is coverable over the hole 16. The flap member 17 has a top edge 18 which is conventionally attached to the front side 15 of the upper body garment 11 above the hole 16. The flap member 17 is hingedly and conventionally attached to the upper body garment 11. The flap member 17 is a circular piece of material having an outer side 20 and an underside 19 with the outer side 20 having a decorative design displayed thereupon.

In use, the user wears the garment 11 just like a regular t-shirt for example, and when the medical procedure such as gastronomical feeding is needed, a hose is inserted through the hole 16 of the garment 11. Once the feeding is finished, the hose is removed and the flap member 17 is placed over the hole 16.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A feeding tube accessible apparel system comprising:

an upper body garment having a neck-receiving opening and arm-receiving openings and also having a front side with a hole being disposed through said front side;

a gastrointestinal access hose for engaging a gastrointestinal port on the body of the wearer, said gastrointestinal access hose being removably inserted through said hole of said upper body garment; and a flap member being attached to said front side of said upper body garment, an upper portion of said flap member being fixed to the front side of said upper body garment, a lower portion of said flap member being positioned over said hole in said upper body garment, said lower portion of said upper body garment being free of attachment to said upper body garment such that said lower portion is pivotable away from said front side of said upper body garment o expose said hole.

2. A feeding tube accessible apparel system as described in claim 1, wherein said flap member is a circular piece of material having an outer side and an underside, said outer side having a decorative design displayed thereupon.

3. A feeding tube accessible apparel system comprising:

an upper body garment having a neck-receiving opening and arm-receiving openings and also having a front side with a hole being disposed through said front side, said hole being adapted to receive a gastronomical feeding tube therethrough;

a gastrointestinal access hose for engaging a gastrointestinal port on the body of the wearer, said gastrointestinal access hose being removably inserted through said hole of said upper body garment; and a flap member being attached to said front side of said upper body garment, an upper portion of said flap member being fixed to the front side of said upper body garment, a lower portion of said flap member being positioned over said hole in said upper body garment, said lower portion of said upper body garment being free of attachment to said upper body garment such that said lower portion is pivotable away from said front side of said upper body garment to expose said hole;

wherein said flap member comprises a circular piece of material having an outer side and an underside, said outer side having a decorative design displayed thereupon;

wherein said upper body garment has a lower torso-receiving opening, a midline of said upper body garment extending substantially parallel to and equidistant between edges defining said neck-receiving opening and said torso-receiving opening, and wherein said hole is positioned between said midline and said torso-receiving opening.

4. A feeding tube accessible apparel system as described in claim 1, wherein said upper body garment has a lower torso-receiving opening, a midline of said upper body garment extending substantially parallel to and equidistant between edges defining said neck-receiving opening and said torso-receiving opening, and wherein said hole is positioned between said midline and said torso-receiving opening.

* * * * *